US005896687A

United States Patent [19]

Lo

[11] Patent Number: 5,896,687

[45] Date of Patent: Apr. 27, 1999

[54] DOUBLE-LAYERED AND BI-DIRECTIONAL ROTARY DECORATION

[76] Inventor: Szu Wei Lo, 7F-1, No. 3, Lane 173, Liu-Ho Road, Pu-Li Chen, Nan-Tou Hsien, Taiwan

[21] Appl. No.: 08/999,011

[22] Filed: Dec. 29, 1997

[51] Int. Cl.[6] ..... G09F 19/08

[52] U.S. Cl. ..... 40/411; 40/409; 40/414; 440/298; 440/357

[58] Field of Search ..... 40/409, 410, 411, 40/414; 446/265, 267, 298, 357

[56] References Cited

U.S. PATENT DOCUMENTS 5,555,656 9/1996 Liu ..... 40/411
5,620,353 4/1997 Lai ..... 40/411 X
5,675,921 10/1997 Lin ..... 40/409
5,705,759 1/1998 De Vivo ..... 40/410 X

*Primary Examiner*—Joanne Silbermann
*Assistant Examiner*—Daniel Gambrill

[57] ABSTRACT

A double-layered and bi-directional rotary decoration including a base seat assembly, a driving mechanism, a lower rotary mechanism and an upper rotary mechanism. When a driving motor of the driving mechanism drives a first gear to rotate, a second and a third gears are rotated in a reverse direction and a fourth gear is rotated in the same direction as the first gear so that the lower rotary mechanism disposed with first decorative articles and the upper rotary mechanism disposed with second decorative articles are rotated in reverse directions to achieve a double-layered and bi-directional live visual effect.

3 Claims, 4 Drawing Sheets

DOUBLE-LAYERED AND BI-DIRECTIONAL ROTARY DECORATION

BACKGROUND OF THE INVENTION

The present invention relates to a double-layered and bi-directional rotary decoration in which a lower rotary mechanism disposed with first decorative articles and an upper rotary mechanism disposed with second decorative articles are rotated in reverse directions.

FIG. 1 shows a conventional rotary decoration including a base seat 11, a central rotary disc 12, multiple vertical rods 13 disposed on the central rotary disc 12 and multiple animal decorative articles 14 disposed on the vertical rods 13. When the central rotary disc 12 is rotated, all these decorative articles 14 will be rotated only in one direction. This can only provide monotonous visual effect.

SUMMARY OF THE INVENTION

It is therefore a primary object of the present invention to provide a double-layered and bi-directional rotary decoration including two layers of decorative articles rotated in different directions to achieve live visual effect.

It is a further object of the present invention to provide the above decoration which has simplified driving structure to achieve a double-layered and bi-directional effect.

According to the above objects, the double-layered and bi-directional rotary decoration of the present invention includes:

a base seat assembly including a base seat and an annular outer wall upward extending from the base seat and formed with multiple windows;

a driving mechanism disposed on the base seat, including a driving motor, a first gear driven by the motor and a second gear engaged with the first gear, the second gear being rotatably disposed on the base seat;

a lower rotary mechanism including a circular top disc having a central hole, a bottom face of the top disc being disposed with a hollow third gear, an annular inner wall downward extending from a periphery of the top disc, a bottom edge of the inner wall having a horizontally extending flange section on which multiple first decorative articles are disposed, the third gear being engaged with the first gear;

an upper rotary mechanism including a vertical central shaft passing through the central hole, a top end of the central shaft being disposed with an engaging seat, a bottom end of the central shaft being rotatably disposed on the base seat, a fourth gear being disposed at a center of the central shaft and engaged with the first gear, a second decorative article via an engaging section being secured on the engaging seat;

whereby when the driving motor drives the first gear to rotate, the second and third gears are rotated in a reverse direction and the fourth gear is rotated in the same direction as the first gear so that the lower rotary mechanism disposed with the first decorative article and the upper rotary mechanism disposed with the second decorative article are rotated in reverse directions to achieve a double-layered and bi-directional effect.

The present invention can be best understood through the following description and accompanying drawings, wherein:

DETAILED DESCRIPTION OF THE PREFERRED EMBODIMENTS

Figure 1:
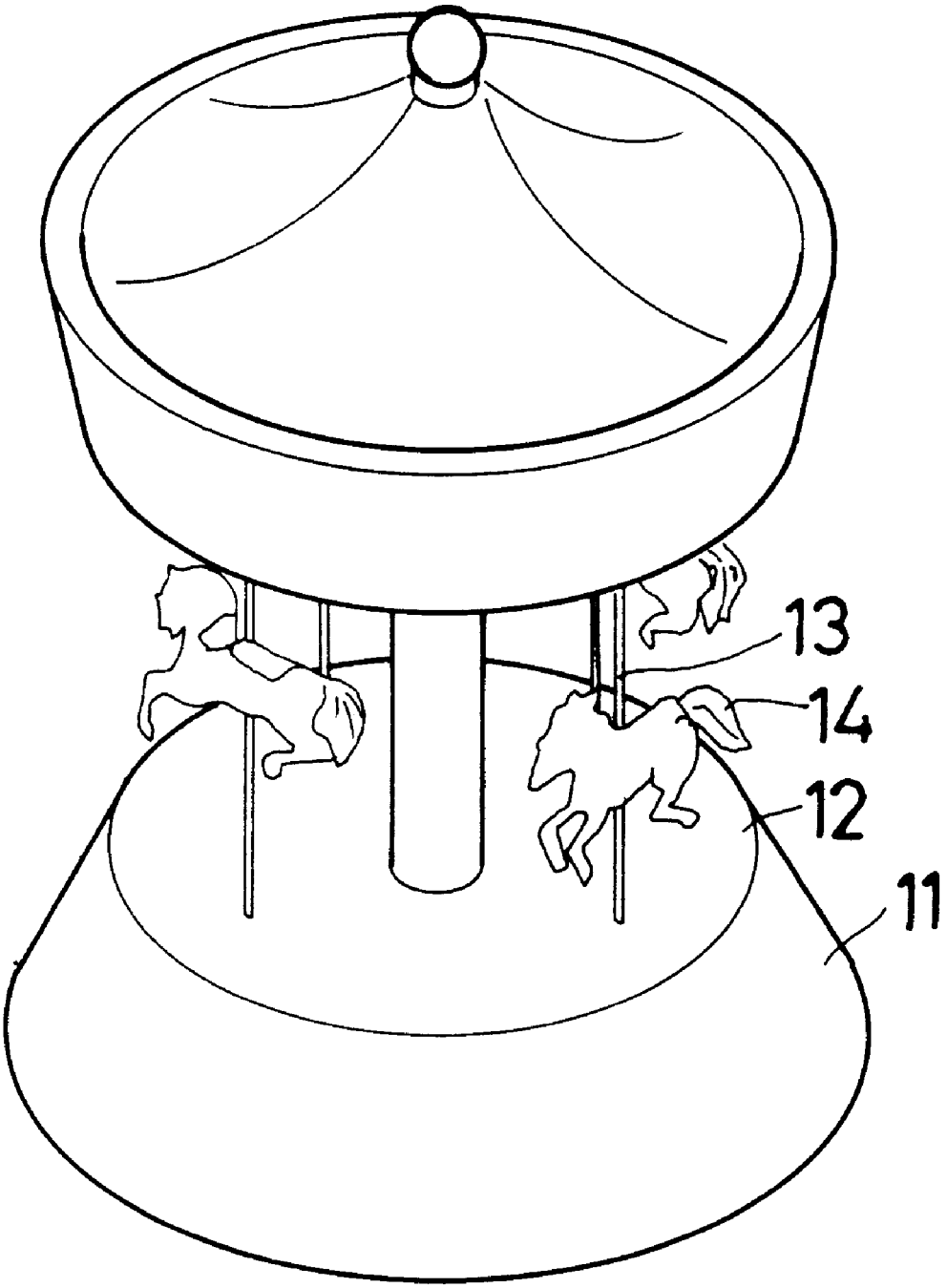
FIG. 1 PRIOR ART
FIG. 1 is a perspective view of a conventional rotary decoration.
Figure 2:
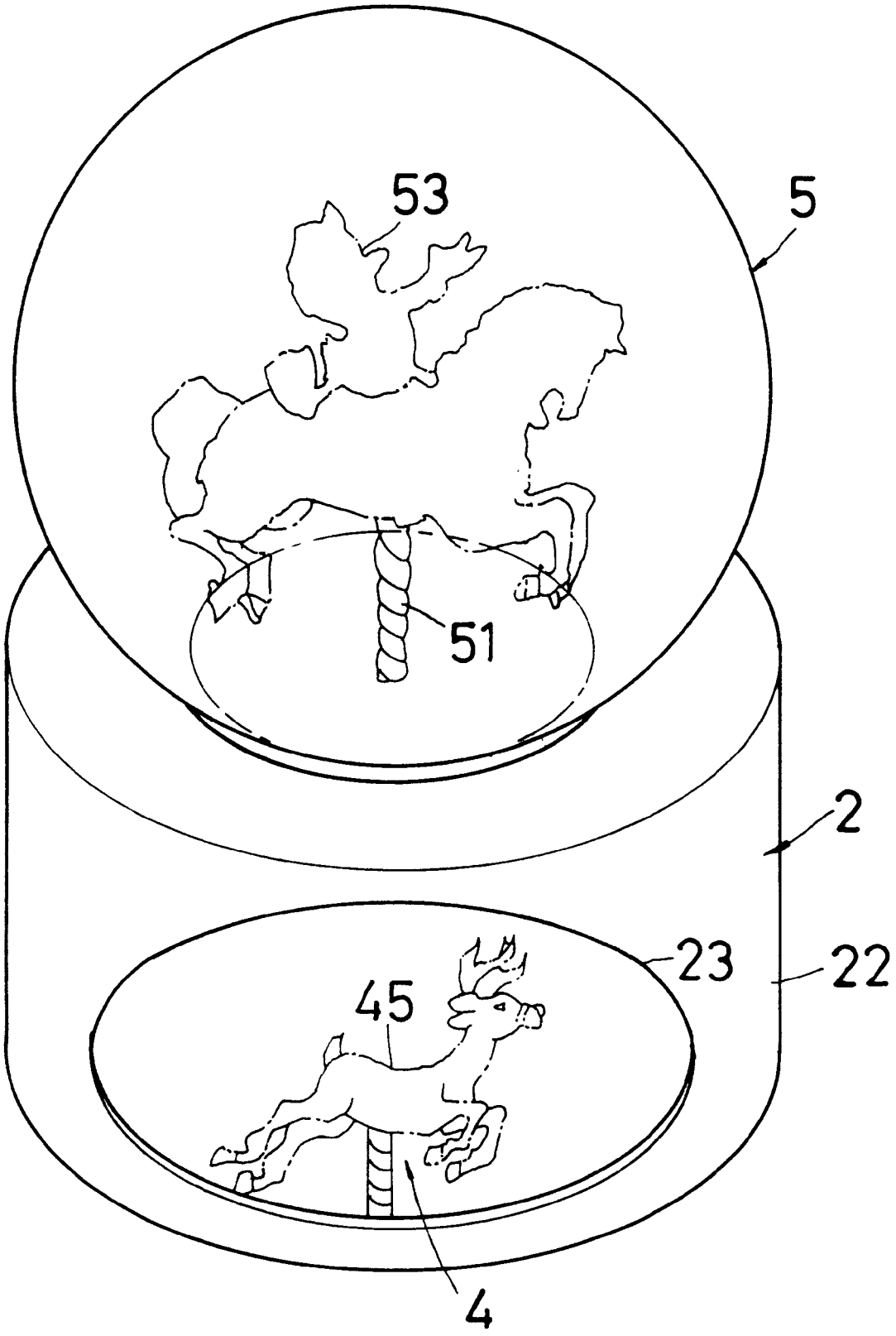
FIG. 2 is a perspective view of the present invention.
Figure 3:
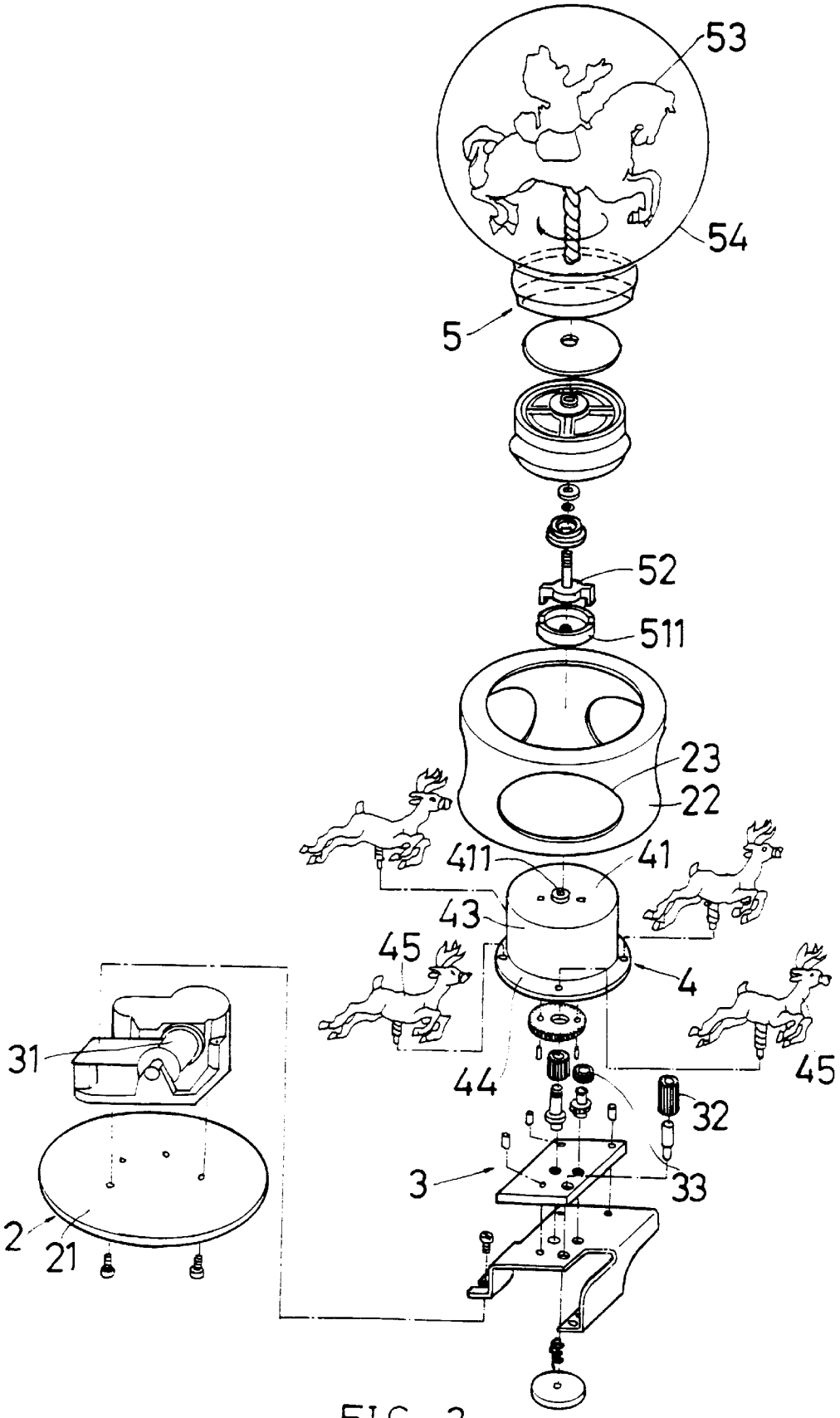
FIG. 3 is a perspective exploded view of the present invention.
Figure 4:
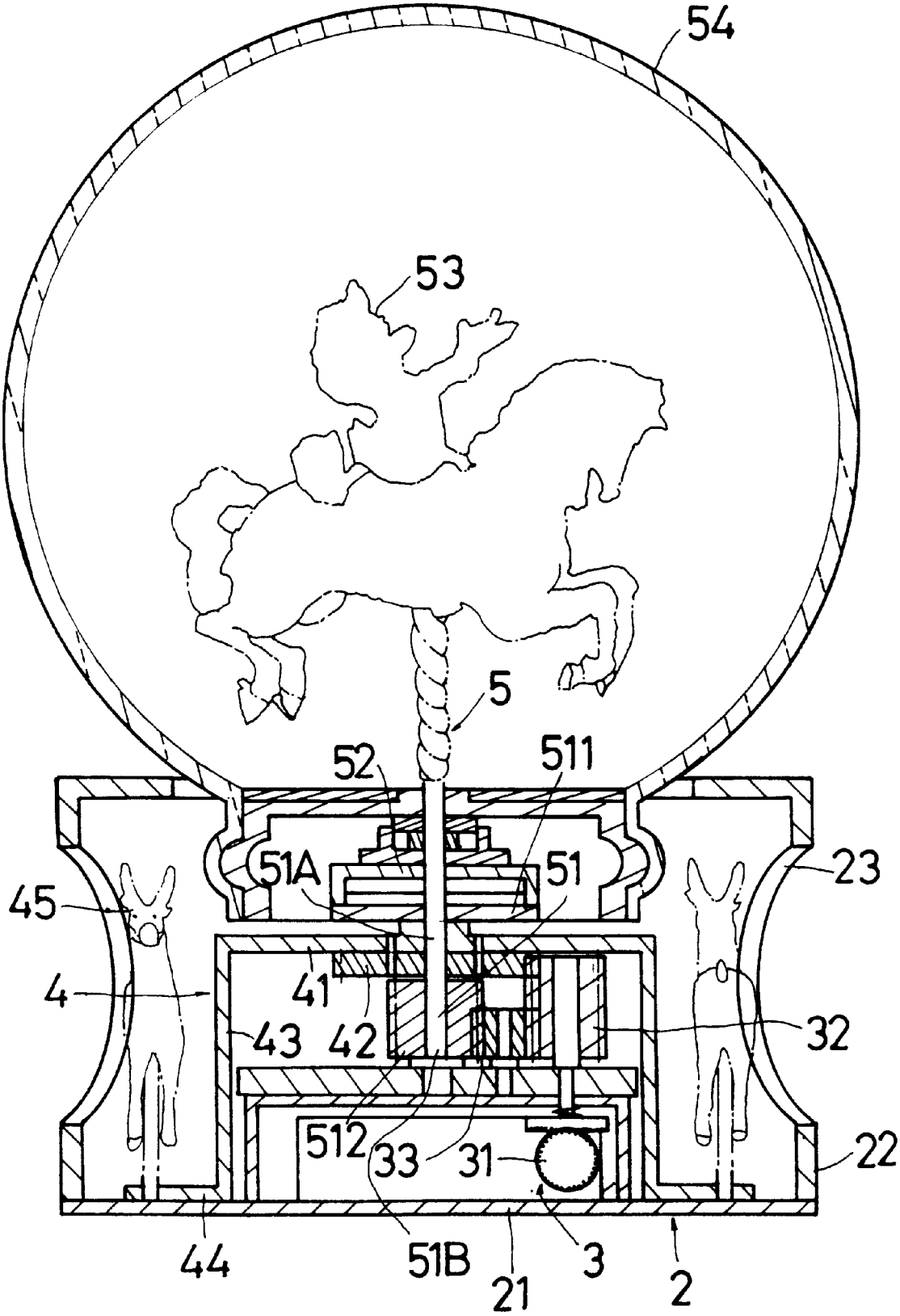
FIG. 4 is a sectional assembled view of the present invention.

Please refer to FIGS. 2 to 4. The present invention includes a base seat assembly 2, a driving mechanism 3, a lower rotary mechanism 4 and an upper rotary mechanism 5.

The base seat assembly 2 includes a base seat 21 and an annular outer wall 22 upward extending from the base seat 21 and formed with multiple windows 23.

The driving mechanism 3 is disposed on the base seat 21, including a driving motor 31, a first gear 32 driven by the motor 31 and a second gear 33 engaged with the first gear 32. The second gear 33 is rotatably disposed on the base seat 21.

The lower rotary mechanism 4 includes a circular top disc 41 having a central hole 411. A bottom face of the top disc 41 is disposed with a hollow third gear 42. An annular inner wall 43 downward extends from the periphery of the top disc 41. The bottom edge of the inner wall 43 has a horizontally extending flange section 44 on which four first decorative articles 45 are disposed. The third gear 42 is engaged with the first gear 32. The annular inner wall 43 and the annular outer wall 22 define an even annular space.

The upper rotary mechanism 5 includes a vertical central shaft 51 passing through the central hole. A top end 51A of the central shaft 51 is disposed with an engaging seat 511. A bottom end 51B of the central shaft 51 is rotatably disposed on the base seat 21. A fourth gear 512 is disposed at the center of the central shaft and engaged with the first gear 32. A second decorative article 53 via an engaging section 52 is secured on the engaging seat 511.

Accordingly, when the driving motor 31 drives the first gear 32 to rotate, the second and third gears 32, 42 are rotated in a reverse direction and the fourth gear 512 is rotated in the same direction as the first gear 32. Therefore, the lower rotary mechanism 4 disposed with the first decorative article 45 and the upper rotary mechanism 5 disposed with the second decorative article 53 are rotated in reverse directions. (One is clockwise rotated, while the other is counterclockwise rotated.) Therefore, a double-layered and bi-directional effect is achieved.

In practice, the upper rotary mechanism 5 can further include a transparent glass ball housing 54 for enclosing the second decorative article 53. The glass ball housing 54 is secured on the engaging section 52 to present a bright and smooth effect.

The above arrangement can be modified as necessary. For example, the first and second decorative articles 45, 53 can be running animals such as horses, deers, etc. or other patterns such as cartoon characters or pets. The number of the decorative articles can be arbitrarily increased or decreased as necessary.

It is to be understood that the above description and drawings are only used for illustrating some embodiments of the present invention, not intended to limit the scope thereof. Any variation and derivation from the above description and drawings should be included in the scope of the present invention.

What is claimed is:

1. A double-layered and bi-directional rotary decoration comprising:

a base seat assembly including a base seat and an annular outer wall upward extending from the base seat and formed with multiple windows;

a driving mechanism disposed on the base seat, including a driving motor, a first gear driven by the motor and a second gear engaged with the first gear, the second gear being rotatably disposed on the base seat;

a lower rotary mechanism including a circular top disc having a central hole, a bottom face of the top disc being disposed with a hollow third gear, an annular inner wall downward extending from a periphery of the top disc, a bottom edge of the inner wall having a horizontally extending flange section on which multiple first decorative articles are disposed, the third gear being engaged with the first gear;

an upper rotary mechanism including a vertical central shaft passing through the central hole, a top end of the central shaft being disposed with an engaging seat, a bottom end of the central shaft being rotatably disposed on the base seat, a fourth gear being disposed at a center of the central shaft and engaged with the first gear, a second decorative article via an engaging section being secured on the engaging seat;

whereby when the driving motor drives the first gear to rotate, the second and third gears are rotated in a reverse direction and the fourth gear is rotated in the same direction as the first gear so that the lower rotary mechanism disposed with the first decorative article and the upper rotary mechanism disposed with the second decorative article are rotated in reverse directions to achieve a double-layered and bi-directional effect.

2. A decoration as claimed in claim 1, wherein the upper rotary mechanism further include a transparent glass ball for housing enclosing the second decorative article.

3. A decoration as claimed in claim 1, wherein the first and second decorative articles are running animals.

* * * * *